US007552990B2

(12) United States Patent
Beak et al.

(10) Patent No.: US 7,552,990 B2
(45) Date of Patent: Jun. 30, 2009

(54) METHOD AND APPARATUS OF DOT COUNTING IN AN IMAGE FORMING APPARATUS

(75) Inventors: O-hyun Beak, Seoul (KR); Tae-kyun Kim, Yongin-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 394 days.

(21) Appl. No.: 11/496,516

(22) Filed: Aug. 1, 2006

(65) Prior Publication Data

US 2007/0046702 A1 Mar. 1, 2007

(30) Foreign Application Priority Data

Aug. 24, 2005 (KR) ..... 10-2005-0078021

(51) Int. Cl.
*B41J 29/393* (2006.01)

(52) U.S. Cl. ..... 347/19

(58) Field of Classification Search ..... 347/19, 347/22–35, 49

See application file for complete search history.

(56) References Cited

U.S. PATENT DOCUMENTS 6,033,051 A 3/2000 Kaneko
6,231,156 B1 * 5/2001 Ono ..... 347/24
6,704,144 B2 3/2004 Huang
2002/0054182 A1 5/2002 Yazawa
2004/0165030 A1 8/2004 Sakamoto et al.
2004/0207683 A1 10/2004 Sonobe

FOREIGN PATENT DOCUMENTS

JP 08-156281 6/1996
JP 2004-351657 12/2004

OTHER PUBLICATIONS

Office Action dated Mar. 13, 2006 of Korean Application No. 10-2004-0068034.

* cited by examiner

*Primary Examiner*—Matthew Luu
*Assistant Examiner*—Justin Seo
(74) *Attorney, Agent, or Firm*—Stanzione & Kim, LLP

(57) ABSTRACT

A method and apparatus of dot counting. The apparatus includes a nozzle portion having a length corresponding to a width of a printing medium, a dot counting unit to group head nozzles by position and to count a discharged dot count per line for each group, a control unit to determine whether the group has been used to print using the discharged dot count per line, a counter to count a number of times that the group is used to print based on the determination result, and a memory to store a sum of the counted numbers of times, in which the control unit controls the counter to count the number of times that the group is used to print with respect to each line of image data when the image data is created by a head chip, and a sum of the counted number of times is stored in the memory.

8 Claims, 3 Drawing Sheets

METHOD AND APPARATUS OF DOT COUNTING IN AN IMAGE FORMING APPARATUS

CROSS-REFERENCE TO RELATED APPLICATIONS

This application claims priority under 35 U.S.C. §119(a) from Korean Patent Application No. 10-2005-0078021, filed on Aug. 24, 2005, in the Korean Intellectual Property Office, the disclosure of which is incorporated herein in its entirety by reference.

BACKGROUND OF THE INVENTION

1. Field of the Invention

The present general inventive concept relates to a method and apparatus of dot counting, and more particularly, to a method and apparatus of dot counting with respect to each head chip of a group of head chips of an inkjet printer which includes a nozzle portion having a size corresponding to a width of a printing medium.

2. Description of the Related Art

An inkjet image forming apparatus may perform only a printing function, or may perform multiple functions combined with a copy machine, facsimile, and scanner. A non-impact type inkjet image forming apparatus produces less printing noise than a dot-matrix printer. In addition, the inkjet image forming apparatus can be light and compact, and a color ink cartridge may be used for color printing. Minute droplets of ink are discharged to a desired position on a printing medium by an inkjet head of the inkjet image forming apparatus. The inkjet head, which is included in a cartridge and is connected with an ink storage unit, is placed in the inkjet image forming apparatus. The inkjet head uses heat or piezoelectric elements as a driving source for discharging ink to provide a high resolution through semiconductor manufacturing processes, such as etching, deposition, and sputtering.

A nozzle portion of the inkjet head disperses the ink onto the printing medium. After printing, ink or foreign materials remain on a surface of the nozzle portion. The remaining ink or foreign materials can block holes of the nozzle portion over time, which can prevent a nozzle from dispersing ink droplets. In addition, a dispersion direction of an ink droplet dispersed by the nozzle may be changed, and an impact area of the ink droplet may be diverged. Thus, in order to maintain a clean surface of the nozzle portion of the inkjet image forming apparatus, a wiping element is provided for wiping the ink or foreign materials from the surface of the nozzle portion. Further, a spitting element is provided for removing foreign materials from the holes of the nozzle portion by dispersing ink in order to prevent the nozzle portion from clogging. Further, a capping element is provided for preventing the ink from drying and for protecting the nozzle portion from external foreign materials by covering the nozzle portion.

The wiping element, the spitting element, and the capping element are generally referred to as a maintenance element. An area of the inkjet image forming apparatus containing the maintenance element, where a maintenance operation is carried out, is referred to as a maintenance area. To miniaturize the inkjet image forming apparatus, the maintenance element must be miniaturized.

In a conventional inkjet image forming apparatus, ink is dispersed onto paper from an inkjet head (i.e., a shuttle type inkjet head) which reciprocates perpendicular to a feed direction of the paper (i.e., widthwise across the paper) to form an image. A nozzle portion of the inkjet image forming apparatus has a plurality of nozzles for discharging ink and is provided in the inkjet head. Instead of the shuttle type inkjet head, a line inkjet head, which includes a nozzle portion having a length corresponding to a width of a printing medium in a main scanning direction, has started to be used for high speed printing. Since the inkjet image forming apparatus having the line inkjet head has a fixed inkjet head and only the printing medium is transferred, high speed printing can be achieved with a simple driving element. For example, for A4 size paper, the length of the nozzle portion is approximately 210 mm, when a printing margin is not taken into consideration.

Conventionally, in order to carry out a maintenance operation of an inkjet printer having a plurality of head chips on an inkjet head, a number of ink droplets discharged from each inkjet head chip is counted, and the number of ink droplets counted until a printing medium (e.g., a sheet of paper) is completely printed is compared with a predetermined value. If the counted number of ink droplets exceeds the predetermined value, the maintenance operation (such as spitting, wiping, or capping) is carried out. In this method, the number of ink droplets discharged from each ink head chip in a printer carriage is counted to determine a service cycle for the plurality of head chips.

However, the conventional method has a problem in that an amount of dot printing for each nozzle of the plurality of head chips cannot be correctly estimated when using an inkjet head which includes a nozzle portion having a size corresponding to a width of a printing medium in a main scanning direction perpendicular to a feeding direction of the printing medium. In addition, since a nozzle usage is different for each head chip, it is hard to estimate when to start a maintenance operation.

SUMMARY OF THE INVENTION

The present general inventive concept provides a method and apparatus of dot counting, in which head nozzles are grouped by position to form a plurality of groups of nozzles, a discharged dot count per line ("dot count" or "discharged dot count") is counted for each group of nozzles, and a counted number of times that each group of nozzles is used to print is increased by one or remains the same according to a determined result of whether each group has been used to print based on the corresponding dot count.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing an apparatus to count dots of an image forming device which includes a nozzle portion having a size corresponding to a width of a printing medium and having a head chip, the apparatus including a dot counting unit to group head nozzles of the head chip to form a plurality of groups of nozzles based on a position of the head nozzles on the head chip, and to count a discharged dot count per line for each group of the plurality of groups of nozzles, a control unit to determine whether a group of nozzles of the plurality of groups of nozzles has been used to print using the corresponding discharged dot count per line, a counter to count a number of times that the group of nozzles is used to print based on the determination result, and a memory to store the counted number of times, wherein when image data is created by the group of nozzles, the control unit controls the counter to count the number of times that the group of nozzles is used to print for each line of the image data, and a sum of the counted numbers of times is stored in the memory.

The head chip may be composed of an odd row of head nozzles and an even row of head nozzles. The odd row of the head nozzles may include a first number of groups of nozzles, and the even row of head nozzles may include a second number of groups of nozzles. The odd row of head nozzles and the even row of head nozzles may include the plurality of groups of nozzles.

The control unit determines that the group of nozzles has been used to print when the group of nozzles has as many as m nozzles and the corresponding discharged dot count per line is greater than m/2.

The control unit may create a sub group having as many as m nozzles by combining as many as m/2 nozzles from the group of nozzles and as many as m/2 nozzles from an adjacent group adjacent to the group of nozzles on the head chip, and controls the counter to count a number of times that the sub group is used to print for every line of the image data, and a sum of the counted number of times that the sub group is used to print is stored in the memory.

The control unit may perform maintenance on at least the group of nozzles or the sub group of nozzles when the number of times that the group of nozzles or the sub group of nozzles is used to print exceeds a critical reference value.

The maintenance may perform at least one of a spitting operation, a wiping operation, and a suction operation.

The foregoing and/or other aspects and utilities of the present general inventive concept may also be achieved by providing method of dot counting of an image forming apparatus which includes a nozzle portion having a size corresponding to a width of a printing medium and having a head chip, the method including creating image data using the head chip, counting a discharged dot count per line for each of a plurality of groups of head nozzles grouped based on a position of the head nozzles on the head chip, determining whether a group of nozzles of the plurality of groups of nozzles has been used to print using the corresponding discharged dot count per line, counting a number of times that the group of nozzles is used to print based on the determination result, and storing a sum of the counted numbers of the times in a memory.

The head chip may be composed of an odd row of head nozzles and an even row of head nozzles.

The control unit may determine that the group of nozzles has been used to print when the group of nozzles has as many as m nozzles and the corresponding discharged dot count per line is greater than m/2.

The method may further include after the counting of the number of times that the group of nozzles is used to print, creating a sub group having as many as m nozzles by combining as many as m/2 nozzles from the group of nozzles and as many as m/2 nozzles from an adjacent group of nozzles adjacent to the group of nozzles on the head chip, counting a number of times that the sub group of nozzles is used to print for every line of the image data; and storing a sum of the counted number of times in the memory.

The method may further include performing maintenance on at least the group of nozzles or the sub group of nozzles when the sum of the numbers of times that the group of nozzles or the sub group of nozzles is used to print exceeds a critical reference value.

The maintenance may include at least one of spitting, wiping, and suction operations.

The foregoing and/or other aspects and utilities of the present general inventive concept may also be achieved by providing a computer-readable medium having embodied thereon a computer program to execute a method of dot counting of an image forming apparatus which includes a nozzle portion having a size corresponding to a width of a printing medium and having a head chip, the method including creating image data using the head chip, counting a discharged dot count per line for each of a plurality of groups of head nozzles grouped based on a position of the head nozzles on the head chip, determining whether a group of nozzles of the plurality of groups of nozzles has been used to print using the corresponding discharged dot count per line, counting a number of times that the group of nozzles is used to print based on the determination result, and storing a sum of the counted numbers of the times in a memory.

The foregoing and/or other aspects and utilities of the present general inventive concept may be achieved by providing a device to determine whether to perform maintenance on a group of nozzles of a print head of an inkjet image forming apparatus, the device including a counting unit to count a number of ink droplets ejected by the group of nozzles per line of printed image data, and a control unit to analyzing whether the number of the ejected ink droplets is greater than a predetermined threshold number, to modify a print count variable corresponding to a number of times that the group of nozzles has been used to print image data when the number of the ejected ink droplets is greater than the predetermined threshold number, and to determine to perform maintenance on the group of nozzles when the print count variable is greater than or equal to a predetermined reference value.

The counting unit may count a number of ink droplets ejected by a sub group of nozzles per line of printed image data, the sub group of nozzles including one or more nozzles from the group of nozzles and one or more nozzles from a second group of nozzles adjacent to the group of nozzles, and the control unit may analyze whether the number of the ink droplets ejected by the sub group of nozzles is greater than the predetermined threshold number, may modify a print count variable corresponding to a number of times that the sub group of nozzles has been used to print image data when the number of the ink droplets ejected by the sub group of nozzles is greater than the predetermined threshold number, and may determine to perform maintenance on the sub group of nozzles when the print count variable of the sub group of nozzles is greater than or equal to the predetermined reference value.

The foregoing and/or other aspects and utilities of the present general inventive concept may be achieved by providing a method of determining whether to perform maintenance on a group of nozzles of a print head of an inkjet image forming apparatus, the method including counting a number of ink droplets ejected by the group of nozzles per line of printed image data, analyzing whether the number of the ejected ink droplets is greater than a predetermined threshold number, modifying a print count variable corresponding to a number of times that the group of nozzles has been used to print image data when the number of the ejected ink droplets is greater than the predetermined threshold number, and determining to perform maintenance on the group of nozzles when the print count variable is greater than or equal to a predetermined reference value.

The method may further include counting a number of ink droplets ejected by a sub group of nozzles per line of printed image data, the sub group of nozzles including one or more nozzles from the group of nozzles and one or more nozzles from a second group of nozzles adjacent to the group of nozzles, analyzing whether the number of the ink droplets ejected by the sub group of nozzles is greater than the predetermined threshold number, when the number of the ink droplets ejected by the sub group of nozzles is greater than the predetermined threshold number, modifying a print count variable corresponding to a number of times that the sub group of nozzles has been used to print image data, and determining to perform maintenance on the sub group of nozzles when the print count variable of the sub group of nozzles is greater than or equal to the predetermined reference value.

The foregoing and/or other aspects and utilities of the present general inventive concept may be achieved by providing method of determining whether to perform maintenance on a group of nozzles of a print head of an inkjet image forming apparatus, the method including counting a number of ink droplets ejected by the group of nozzles per line of printed image data, comparing the number of the ejected ink droplets to a predetermined threshold number, modifying a print count variable corresponding to a number of times that the group of nozzles has been used to print image data based on the comparison result, and determining to perform maintenance on the group of nozzles by comparing the modified print count variable to a predetermined reference value.

The foregoing and/or other aspects and utilities of the present general inventive concept may be achieved by providing an image forming apparatus, including a head chip having a first group of nozzles, a second group of nozzles, and a sub group of nozzles having a portion of the first group of nozzles and a portion of the second group of nozzles, a counter to count a first number of times, a second number of times, and a sub number of times that the first group of nozzles, the second group of nozzles, and the sub group of nozzles are used to print according to a ratio between one or more used nozzles and one or more unused nozzles, respectively, and a control unit to generate a signal to perform maintenance on the first group, the second, group, and/or the sub group of nozzles according to the counted first, second, and sub number of times.

The foregoing and/or other aspects and utilities of the present general inventive concept may be achieved by providing an image forming apparatus, including a first counter to count a first number of times that a first group of nozzles of a first row is used to print according to a ratio between one or more used ones and one or more unused ones of the first group of nozzles, a second counter to count a second number of times that a second group of nozzles of the first row is used to print according to a ratio between one or more used ones and one or more unused ones of the second group of nozzles, and a control unit to generate a signal to perform maintenance on the first group of nozzles and/or the second group of nozzles according to the counted first and second numbers.

The method may further include a sub counter to count a sub number of times that a sub group of nozzles having a portion of the first group of nozzles and a portion of the second group of nozzles is used to print according to a ratio between one or more used ones and one or more unused ones of the sub group of nozzles, and the control unit may generate the signal to perform the maintenance on the first group, the second group, and/or the sub group of nozzles according to the counted first, second, and sub number of times.

The method may further include a third counter to count a third number of times that a third group of nozzles of a second row is used to print according to a ratio between one or more used ones and one or more unused ones of the third group of nozzles, and a fourth counter to count a fourth number of times that a fourth group of nozzles of the second row is used to print according to a ratio between one or more used ones and one or more unused ones of the fourth group of nozzles, and the control unit may generate the signal to perform the maintenance on the first group, the second group, the third group, and/or the fourth group of nozzles according to the counted first, second, third, and fourth number of times.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
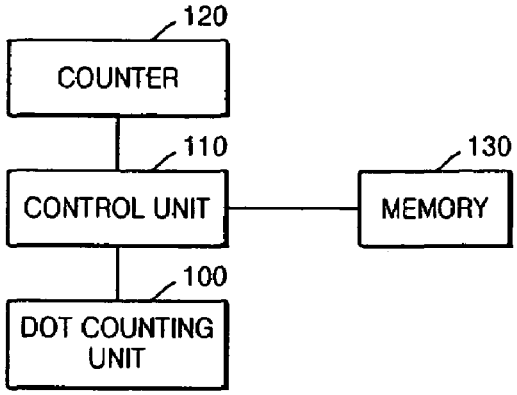
FIG. 1 is a block diagram illustrating an apparatus to count dots ejected from nozzles of an inkjet image forming apparatus, according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a block diagram illustrating an apparatus to count ink dots ejected from nozzles of an inkjet image forming apparatus, according to an embodiment of the present general inventive concept. As illustrated in FIG. 1, the apparatus includes a dot counting unit 100, a control unit 110, a counter 120, and a memory 130.

The inkjet image forming apparatus (e.g., an inkjet printer) includes a nozzle portion having a size (or length) corresponding to a width of a printing medium, and the nozzle portion may have a plurality of head chips including the nozzles. The dot counting unit 100 groups head nozzles (i.e., nozzles of a head chip) by position to form a plurality of groups of nozzles and counts a discharged dot count per line ("dot count" or "discharged dot count") for each group of nozzles of the plurality of groups of nozzles. Here, the head nozzles may be composed of an odd row and an even row. The odd row of the head nozzles may include the groups of nozzles, and the even rows of the head nozzles may also include the groups of nozzles.

The control unit 110 determines whether a group of nozzles has been used to print using the dot count. Specifically, when image data is created by each head chip, the control unit 110 controls the counter 120 to count a number of times that the group of nozzles is used to print for every line of the image data, and the counted number of times is stored in the memory 130. In particular, if the group of nozzles has as many as m nozzles, and if the discharged dot count is greater than a predetermined threshold value (e.g., m/2), then the control unit 110 determines that the group of nozzles has been used to print. In this case, the control unit 110 controls the counter 120 to add one to the counted number of times that the group of nozzles is used to print. However, if the group of nozzles has as many as m nozzles, and if the discharged dot count is equal to or less than the predetermined threshold value (e.g., m/2), then the control unit 110 determines that the group of nozzles has not been used to print. In this case, the control unit 110 does not control the counter 120 to add one to the counted number of times that the group of nozzles is used to print. Although the predetermined threshold value is described above using m/2 as an example, the predetermined threshold value can be a value other than m/2, as desired by a user. For example, the discharged dot count is not required to be greater than half of the number of nozzles of the group of nozzles (i.e., m/2) in order for the control unit 110 to determine that the group of nozzles has been used to print. If the discharged dot count is greater than a number predetermined by a user (e.g., a number other than m/2), the controller 110 can determined that the group of nozzles has been used to print.

In addition, the control unit 110 can create a sub group of nozzles having as many as m nozzles by grouping as many as m/2 nozzles of the group of nozzles and nozzles of an adjacent group of nozzles. Then, a number of times that the sub group is used to print for every line of image data is counted, and a sum of the counted number of times is stored in the memory 130. When a dot count of the sub group of nozzles is greater than the predetermined threshold value (e.g., greater than a number predetermined by the user), the control unit 110 determines that the sub group has been used to print.

If the sum of the number of times that the group of nozzles is used to print exceeds a critical reference value, the control unit 110 performs maintenance on the group of nozzles. Similarly, if the sum of the number of times that the sub group of nozzles is used to print exceeds a critical reference value, the control unit 110 performs maintenance on the sub group of nozzles. The maintenance may include one or more of spitting, wiping, and suction operations. In is possible that the control unit 110 performs maintenance on all the nozzles when the sum of the number of times that the group and/or the sub group is used to print exceeds a critical reference number.

The counter 120 counts the number of times that the group of nozzles, or the sub group of nozzles, is used to print based on the result of the determination by the controller 110.

The memory 130 stores the counted number of times that the group of nozzles, or the sub group of nozzles, is used to print. In addition, the memory 130 may store printing data or scan data of the inkjet image forming apparatus (e.g., the inkjet printer or a multi-function printer).

Figure 2:
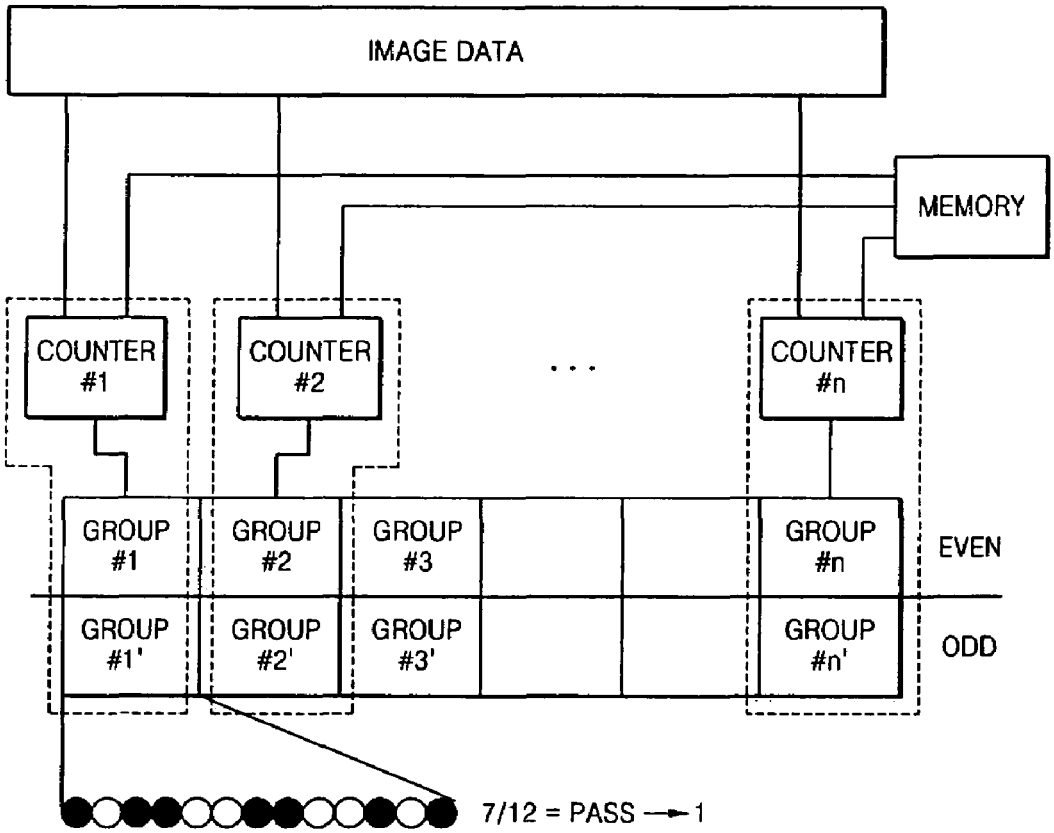
FIG. 2 is a conceptual view illustrating a dot counting apparatus to perform a process in which nozzles of a nozzle portion on a head chip are grouped into a plurality of groups of nozzles, and a determination is made whether a certain group of nozzles of the plurality of groups of nozzles has been used to print, according to an embodiment of the present general inventive concept.

FIG. 2 is a conceptual view illustrating a dot counting apparatus to perform a process in which nozzles of a nozzle portion on a head chip are grouped into a plurality of groups of nozzles, and a determination is made whether a certain group of nozzles of the plurality of groups of nozzles has been used to print using a discharged dot count per line ("dot count" or "discharged dot count") of the group of nozzles, according to an embodiment of the present general inventive concept. It can be seen from FIG. 2 that the nozzle portion is grouped into as many as n groups for each head chip. Furthermore, the discharged dot count per line is counted with respect to each group of nozzles. For example, when a number of nozzles of a Group 1 is 12, and if the discharged dot count of the Group 1 is 7, the discharged dot count is greater than 50% of the number of nozzles. That is, "PASS" indicates that the discharged dot count of 7/12 is greater than 50%. Accordingly, when a predetermined threshold value is 50%, a determination can be made that the Group 1 has been used to print. As a result, a counter #1 increases a number of times that the Group 1 has been used to print by one.

Figure 3:
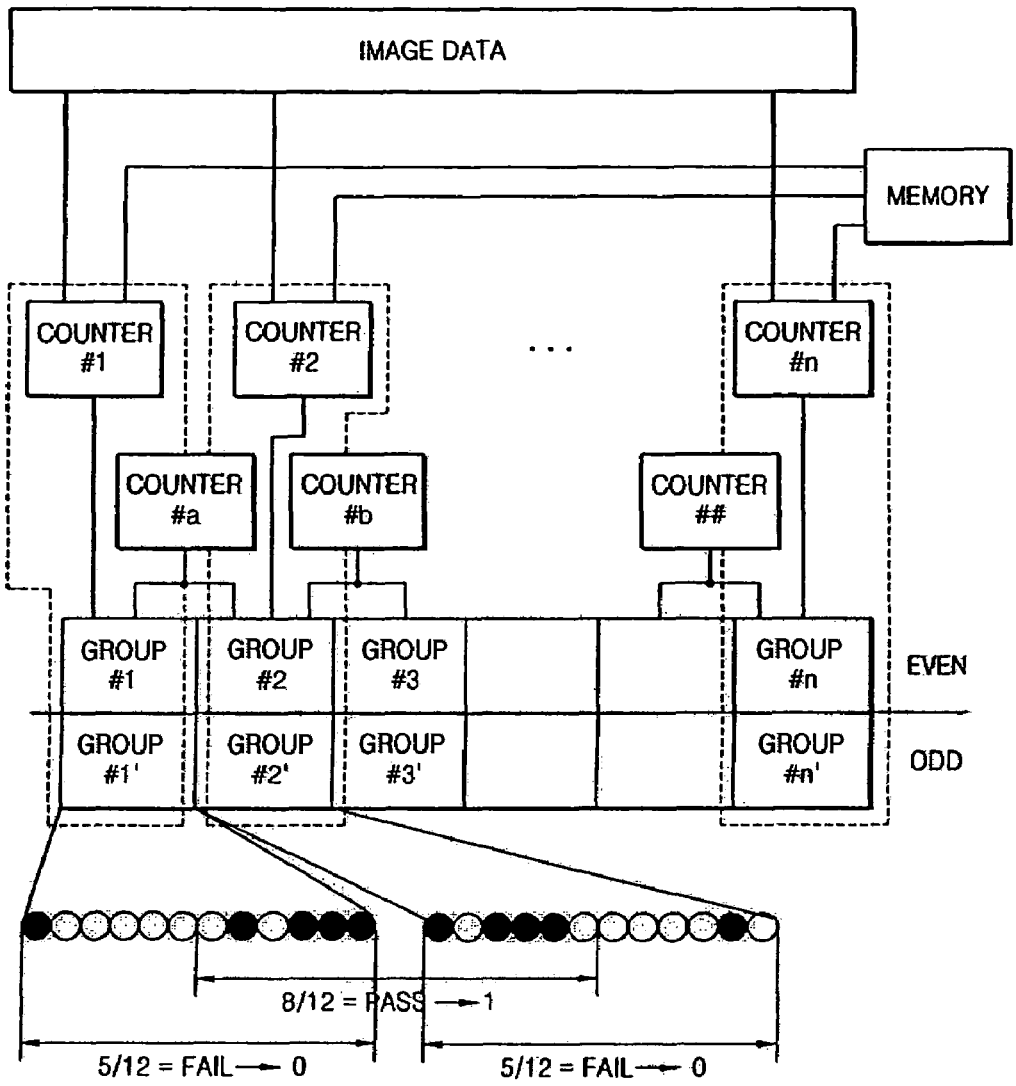
FIG. 3 is a conceptual view illustrating a dot counting apparatus to perform a process in which nozzles of a nozzle portion on a head chip are grouped into a plurality of groups of nozzles, a sub group of nozzles is formed using nozzles of a group of nozzles and an adjacent group of nozzles adjacent thereto, according to an embodiment of the present general inventive concept.

FIG. 3 is a conceptual view illustrating a dot counting apparatus to perform a process in which head nozzles of a nozzle portion on a head chip are grouped into a plurality of groups of nozzles, a subgroup of nozzles is formed using one or more nozzles of a group of nozzles and an adjacent group of nozzles adjacent thereto, and a determination is made whether the sub group of nozzles of the plurality of groups of nozzles has been used to print using a discharged dot count per line ("dot count" or "discharged dot count") of the sub group of nozzles, even when the group of nozzles is determined not to have been used to print, according to an embodiment of the present general inventive concept. It can be seen from FIG. 3 that a Group 1 and a Group 2 have not been used to print, since a discharged dot count for each of Groups 1 and 2 is only 5 out of 12 nozzles, which is below a threshold value of 50%. Here, "FAIL" indicates that the discharged dot count of 5/12 is not greater than 50%. However, if 6 nozzles of the Group 1 adjacent to the Group 2 are grouped with 6 nozzles of the Group 2 adjacent to the Group 1 as a sub group, as illustrated in FIG. 3, a discharged dot count of the sub group is 8 out of 12 nozzles, which is greater than the threshold value of 50%. Thus, the sub group can be determined to have been used to print. As a result, a counter #a increases the number of times that the sub group of nozzles has been used to print by one.

Figure 4:
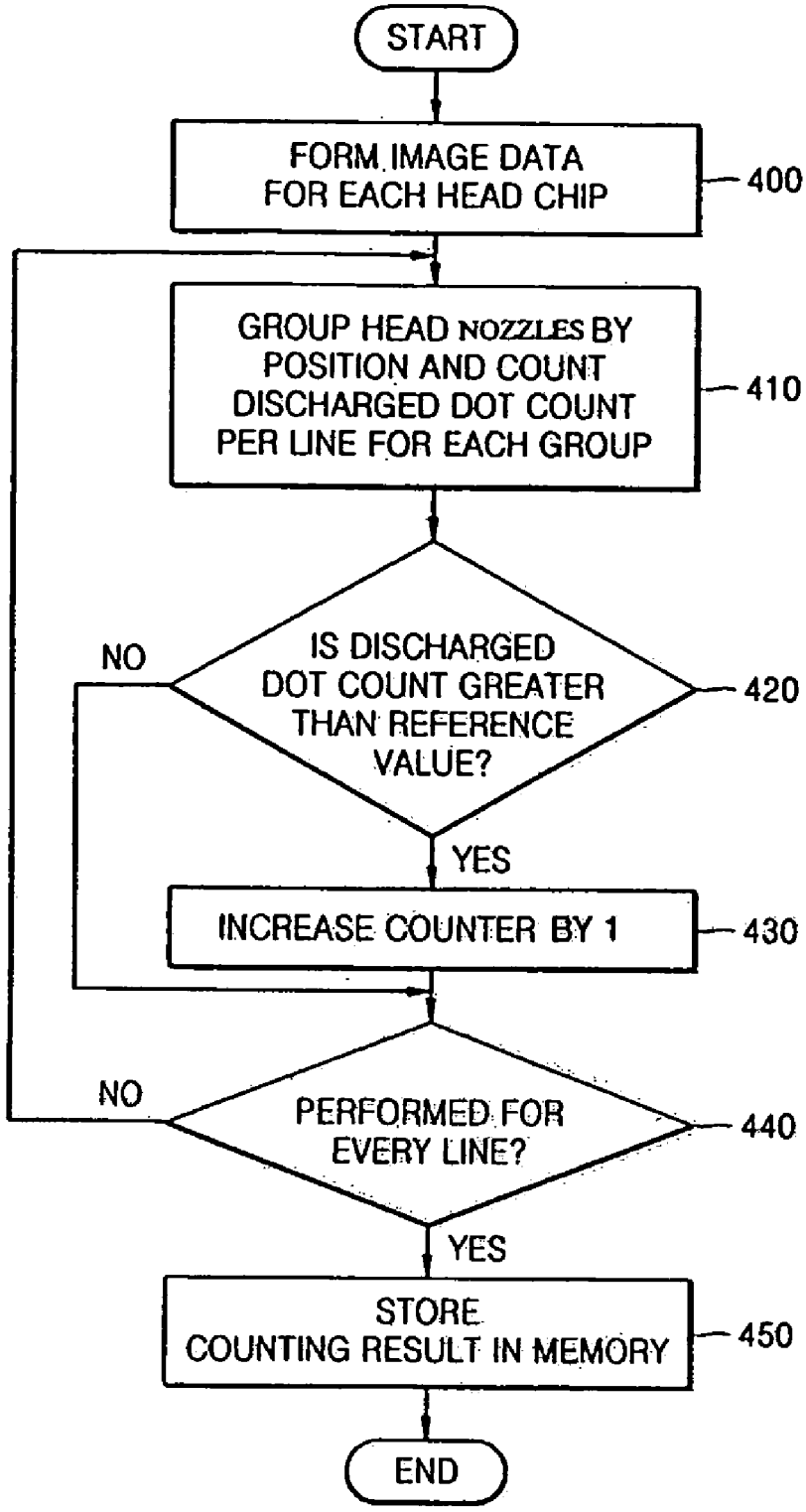
FIG. 4 is a flowchart illustrating a method of dot counting, according to an embodiment of the present general inventive concept.

FIG. 4 is a flowchart illustrating a method of dot counting, according to an embodiment of the present general inventive concept. The method of dot counting of this embodiment will be described with reference to FIGS. 1 and 4.

Image data is created by each head chip of a plurality of head chips of an inkjet image forming apparatus in response to a print instruction (operation 400). After the image data is formed, the head nozzles of each head chip are grouped by position to form a plurality of groups of nozzles on each head chip, and the dot counting unit 100 counts a discharged dot count per line ("dot count" or "discharged dot count") for each group of nozzles (operation 410). The control unit 110 determines whether the discharged dot count for each group of nozzles is greater than a predetermined reference value (operation 420), such as 50% of a number of nozzles in each group of nozzles. For example, if a number of nozzles for one group of nozzles is 12, the predetermined reference value may be 6, or the predetermined reference value may be a number greater than 6.

If the discharged dot count for a group of nozzles is greater than the predetermined reference value, the control unit 110 controls the counter 120 to increase the number of times that the group of nozzles has been used to print by one (operation 430). The control unit 110 determines whether the operations 410-430 have been applied to every line of the image data (operation 440). If the processes have not been applied to every line of the image data, the operations 410-430 are repeated.

If the operations 410-430 have been applied to every line of the image data, a counting result, corresponding to the number of times that each group of the plurality of groups of nozzles has been used to print, is stored in the memory 130 (operation 450).

After the counting result is stored in the memory 130, the counting result stored in the memory 130 may be used to determine whether a maintenance operation will be preformed for each group of the plurality of groups of nozzles.

According to various embodiments of the present general inventive concept, head nozzles are grouped by position to form a plurality of groups of nozzles, a discharged dot count per line ("dot count" or "discharged dot count") is counted for each group of nozzles, and a counted number of times that each group of nozzles is used to print is increased by one or remains the same according to a determined result of whether each group of nozzles has been used to print based on the corresponding dot count. Therefore, there is an advantage in that a nozzle usage can be measured for each group of head chips of an inkjet printer which includes a nozzle portion having a length corresponding to a width of a printing medium, so that a maintenance operation can be carried out based on the nozzle usage.

Various embodiments of the present general inventive concept can be written as computer programs and can be implemented in general-use digital computers that execute the programs using a computer readable recording medium. Examples of the computer readable recording medium include, but are not limited to, magnetic storage media (e.g. ROM, floppy disks, hard disks, etc.), optical recording media (e.g. CD-ROMs, or DVDs), and storage media, such as carrier waves (e.g. transmission through the internet).

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An apparatus to count dots of an image forming device which includes a nozzle portion having a size corresponding to a width of a printing medium and having a head chip, the apparatus comprising:

a dot counting unit to group head nozzles of the head chip to form a plurality of groups of nozzles based on a position of the head nozzles on the head chip, and to count a discharged dot count per line for each group of the plurality of groups of nozzles;

a control unit to determine whether a group of nozzles of the plurality of groups of nozzles has been used to print using the corresponding discharged dot count per line;

a counter to count a number of times that the group of nozzles is used to print based on the determination result; and a memory to store the counted number of times, wherein when image data is created by the group of nozzles, the control unit controls the counter to count the number of times that the group of nozzles is used to print for each line of the image data, and a sum of the counted numbers of times is stored in the memory.

2. The apparatus of claim 1, wherein the head chip is composed of an odd row of head nozzles and an even row of head nozzles.

3. The apparatus of claim 2, wherein the odd row of the head nozzles comprises a first number of groups of nozzles, and the even row of head nozzles comprises a second number of groups of nozzles.

4. The apparatus of claim 2, wherein the odd row of head nozzles and the even row of head nozzles comprise the plurality of groups of nozzles.

5. The apparatus of claim 1, wherein when the group of nozzles has as many as m nozzles and the corresponding discharged dot count per line is greater than m/2, the control unit determines that the group of nozzles has been used to print.

6. The apparatus of claim 5, wherein the control unit creates a sub group having as many as m nozzles by combining as many as m/2 nozzles from the group of nozzles and as many as m/2 nozzles from an adjacent group adjacent to the group of nozzles on the head chip, and controls the counter to count a number of times that the sub group is used to print for every line of the image data, and a sum of the counted number of times that the sub group is used to print is stored in the memory.

7. The apparatus of claim 6, wherein when the number of times that the group of nozzles or the sub group of nozzles is used to print exceeds a critical reference value, the control unit performs maintenance on at least the group of nozzles or the sub group of nozzles.

8. The apparatus of claim 7, wherein the maintenance performs at least one of a spitting operation, a wiping operation, and a suction operation.

* * * * *